US007011611B1

(12) United States Patent
Ripley

(10) Patent No.: US 7,011,611 B1
(45) Date of Patent: Mar. 14, 2006

(54) ADJUSTABLE WEIGHT DUMBELL

(76) Inventor: Barry Ripley, 3113 S.R. 580, #292, Safety Harbor, FL (US) 34695

( * ) Notice: Subject to any disclaimer, the term of this patent is extended or adjusted under 35 U.S.C. 154(b) by 412 days.

(21) Appl. No.: 10/456,699

(22) Filed: Jun. 6, 2003

Related U.S. Application Data

(60) Provisional application No. 60/386,356, filed on Jun. 6, 2002, provisional application No. 60/392,902, filed on Jul. 1, 2002, provisional application No. 60/443,680, filed on Jan. 30, 2003.

(51) Int. Cl.
*A63B 21/075* (2006.01)

(52) U.S. Cl. ..... 482/107; 482/108

(58) Field of Classification Search ..... 482/93–95, 482/97, 106–109; D21/681–683

See application file for complete search history.

(56) References Cited

U.S. PATENT DOCUMENTS

| | | | | |
|---|---|---|---|---|
| 5,344,375 | A * | 9/1994 | Cooper | 482/106 |
| D359,778 | S | 6/1995 | Towley, III et al. | D21/197 |
| 5,637,064 | A | 6/1997 | Olson et al. | 482/108 |
| 5,718,654 | A * | 2/1998 | Kennedy | 482/139 |
| 5,769,762 | A | 6/1998 | Towley, III et al. | 482/93 |
| 5,839,997 | A | 11/1998 | Roth et al. | 482/107 |
| 6,083,144 | A * | 7/2000 | Towley et al. | 482/107 |
| 6,402,666 | B1 * | 6/2002 | Krull | 482/107 |

* cited by examiner

*Primary Examiner*—Jerome W. Donnelly
*Assistant Examiner*—Fenn C. Mathew
(74) *Attorney, Agent, or Firm*—Nikolai & Mersereau, P.A.

(57) ABSTRACT

An adjustable weight exercise device where the weights nest one inside the other to stack the weights. A handle or bar is provided to lift the weights with. A pin extending through a weight and the handle connects the weights to the handle. Each weight has a separate aperture to connect the handle to the weight. Since the weights are nested the handle will lift the weight it is connected to and all the weights nested inside thereby adjusting the weight of the exercise device. The nested weight system can be used with dumbells, barbells or weight lifting exercise machines to quickly, safely and easily change the weights to be lifted.

15 Claims, 8 Drawing Sheets

ADJUSTABLE WEIGHT DUMBELL

The invention relates to provisional application 60/386,356 filed Jun. 6, 2002, provisional application 60/392,902 filed Jul. 1, 2002 and provisional application 60/443,680 filed Jan. 30, 2003.

BACKGROUND OF THE INVENTION

1. Field of the Invention

This invention relates to adjustable weight exercise equipment wherein weights are nested inside each other to add up to the desired weight for dumbbells, barbells and other exercise equipment.

2. Description of the Related Art

In current adjustable weight dumbbells the weight of the dumbbell is varied by adding plates on either side of a handle. The plates are connected to each other by side rails which can be stacked. A pin slides onto selective shelves of various heights on the handle and extend under the side rails to select how many plates are connected to the handle and lifted in the stack to vary the amount of weight lifted in the dumbbell.

In standard barbells a bar having weights shaped as discs are added or subtracted to the bar to change the weight of the barbell. The discs have holes in the center which must be aligned on the bar and then secured to the bar by a device on the end to keep the disks from coming off. This can be a difficult and dangerous process. There is also the risk that the discs can come off the ends if not properly secured.

SUMMARY OF THE INVENTION

A variable weight exercise device with nested weights fitting inside of each other for adjusting the weight of the device. A handle connected to the outermost selected nested weight and engaging the tops of all intervening weights lifts the nested stack of weights. The nested stack can be used with dumbbells, barbells and any other device desiring use of adjustable weights.

OBJECTS OF THE INVENTION

To provide for easily selecting the weight of the exercise device.

To provide for a compact dumbbell or barbell.

To provide for easy storage of a dumbbell or barbell and all the weights.

To provide for an easy to manufacture lower cost dumbbell, barbell or other adjustable weight device.

To provide for ease to changing weights on a dumbbell or barbell.

To provide for a safe way of changing weights on a dumbbell or barbell.

Other objects, advantages and novel features of the present invention will become apparent from the following description of the preferred embodiments when considered in conjunction with the accompanying drawings.

DESCRIPTION OF THE PREFERRED EMBODIMENTS

Figure 1:
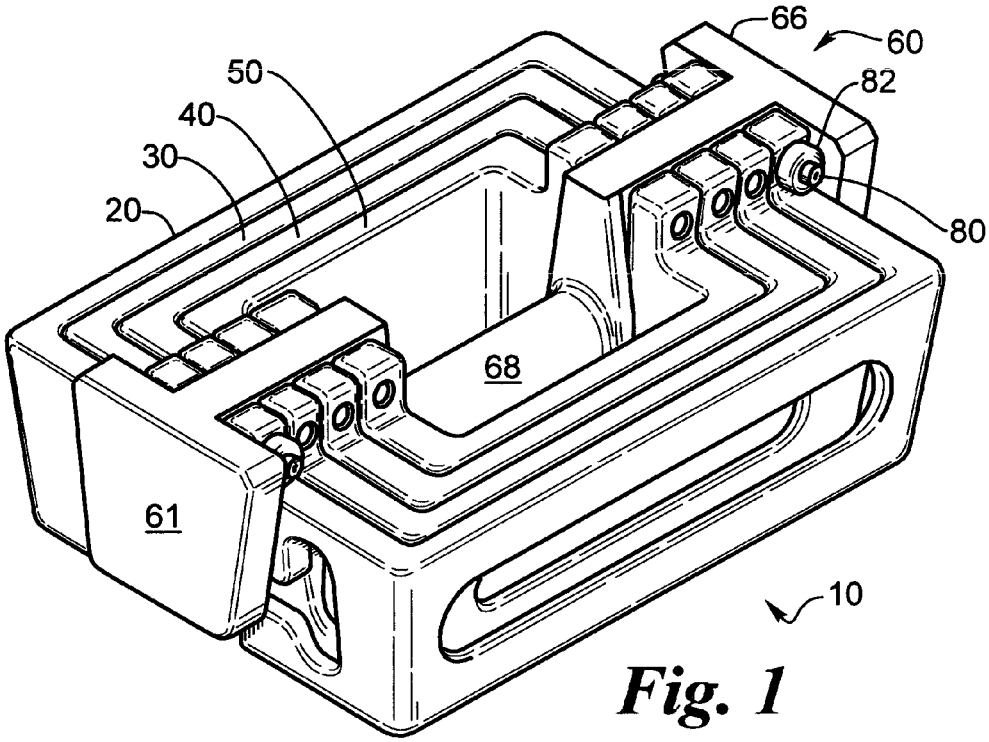
FIG. 1 is a top perspective view of a dumbbell with nested weight plates.

A variable weight dumbbell assembly 10 is shown generally in FIG. 1. In this embodiment the handle 60 and the weights 20, 30 40 and 50 are all of the same weight which in the example is 10 pounds. In this embodiment 50 pounds will be raised when the dumbbell is lifted by a person gripping handgrip 68 on handle 60.

Figure 2:
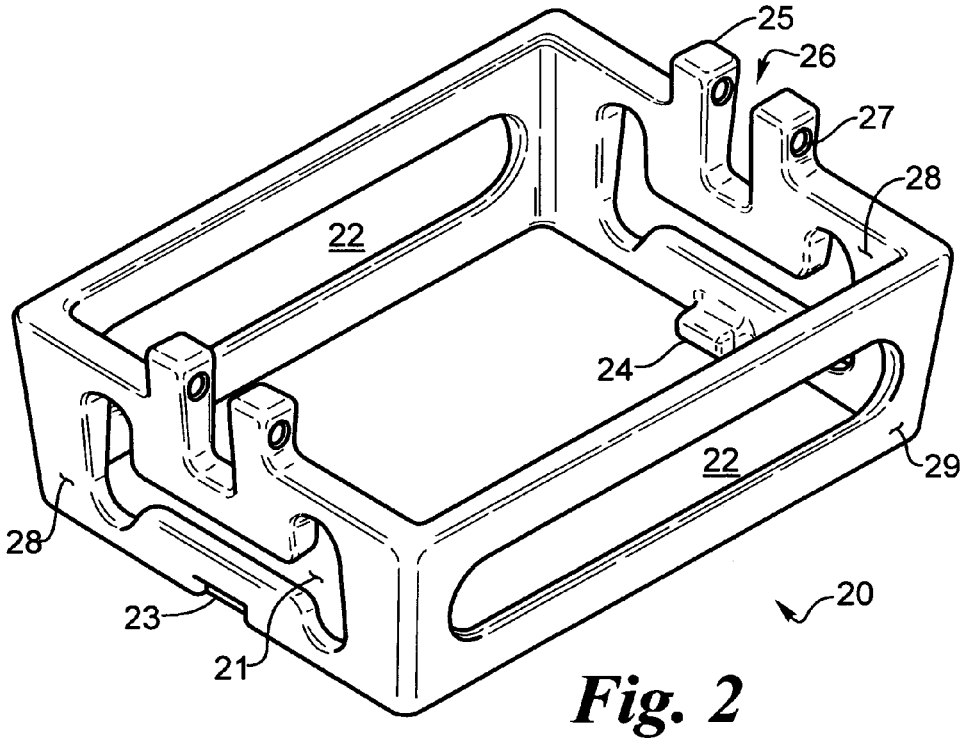
FIG. 2 is a top perspective view of the outermost nested weight plate.

The outermost weight 20 of the variable weight dumbbell assembly 10 is shown in FIG. 2. The end walls 28 and the side walls 29 may be inclined with a larger perimeter on the top than on the bottom to more easily nest one weight within another. The base of weight 20 may have an indented portion 23 for mating with a tab portion of a larger adjacent nested weight if used. The base of weight 20 has a tab portion 24 on end walls 28 to engage the indented portion 33 of an adjacent nested weight 30. Using the tab portion 24 and the indented portion 33 the nested weights 20, 30 bases will be at the same height. The engaging tabs and indents are particularly important if the end walls 28, 38 and the side walls 29, 39 of weights 20 and 30 are not tapered. Although the end walls 28 are shown with the indented portion 23 and the tab portion 24 the side walls 29 could have these features separately or in combination with the end walls 28 or alternatively the indents and tabs could be in the corners or formed by continuous ledges. Similarly although one indent portion 23 and tab portion 24 are shown more than one indent portion 23 and tab portion 24 can be used on each end wall 28.

Weight 20 has a raised forked pin engaging portions 25 with apertures 27 therethrough. A trough 26 between the forked pin engaging portion 25 provides space for the tapered end 69, 79 of bar portion 66, 76 on handle 60 or 70 to fit therein. The handles 60 and 70 can thus have their hand grips 68 and 78 aligned such that they are centered vertically and horizontally in the dumbbell assembly 10.

A pin 80 inserted through the aperture 27 in weight 20 and through aperture 62 or 72 in handle 60 or 70 respectively, locks the weights 20, 30, 40 and 50 under the handle 60 or 70 and allows the user to lift the combined weight of the handle 60, with weights 61, or handle 70 and the weights 20, 30, 40 and 50 which have tabs 24, 34 and 44 engaging indent portions 33, 43, and 53 respectively to hold the weights 20, 30, 40, 50 in the dumbbell assembly 10.

Since the outermost weight 20 has the longest end walls 28 and side walls 29 and weighs the same as the inner most weight 50 which has the shortest end walls 58 and side walls 59 there must be apertures in the end walls 28 and or side walls 29 if the weights are made of the same materials and have the same wall thicknesses and heights. Alternatively the different weights can have the same wall thicknesses and be made of different materials or have different wall thicknesses so that the weights 20, 30 40 and 50 are of equal mass. In other embodiments the different weights 20, 30, 40 and 50 can have different masses.

Figure 3:
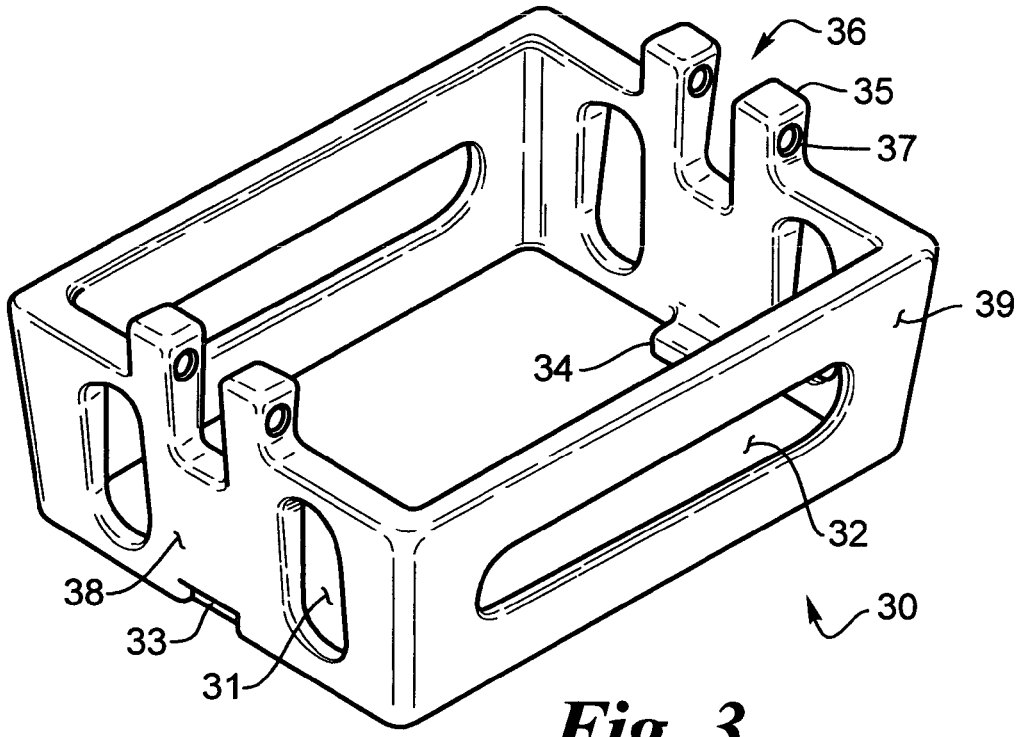
FIG. 3 is a top perspective view of the first nested weight plate.

FIG. 3 shows the first nested weight 30, it has smaller apertures 31 in end walls 38 and smaller apertures 32 in side walls 39 than outer weight 20 since the end walls 38 and side walls 39 are not as long as those in outer weight 20. The indent portion 33 of first nested weight 30 engages the tab portions 24 of outer weight 20 to support the first nested weight 30 in the outer weight 20. Tab portion 34 of first nested weight 30 engages indent portion 43 of second nested weight 40 to support second nested weight 40 in first nested weight 30.

Figure 4:
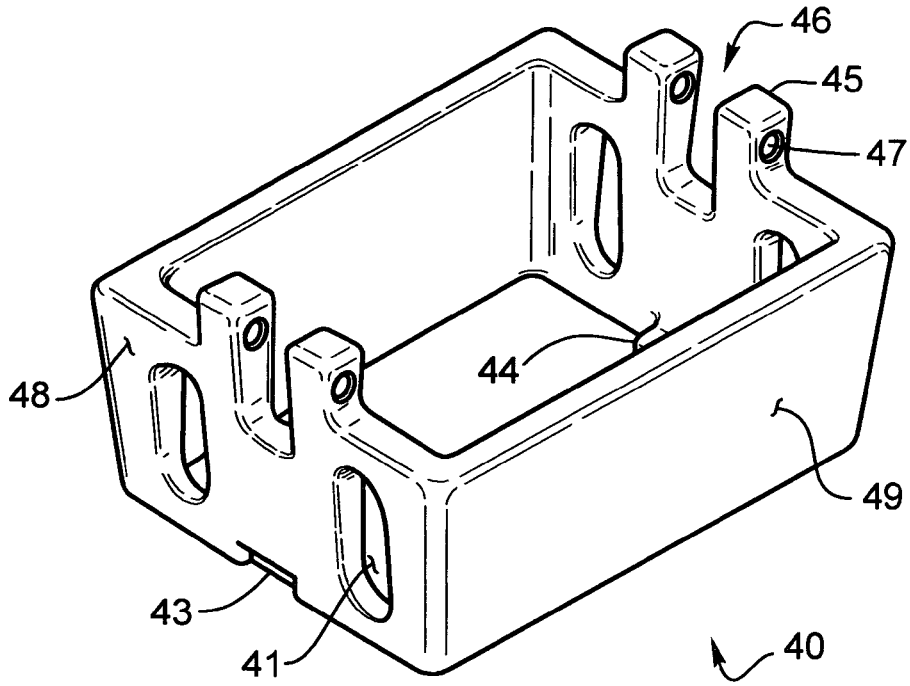
FIG. 4 is a top perspective view of the second nested weight plate.

FIG. 4 shows the second nested weight 40, it has smaller apertures 41 in end walls 48 than in the end walls 38 of second nested weight 30 since the end walls 48 are not as long. There are no apertures in side walls 49. The indent portions 43 of second nested weight 40 engage the tab portions 34 of first nested weight 30 and the tab portion 44 of second nested weight 40 engages third nested weight indent portion 53 to support fourth nested weight 50 in second nested weight 40.

Figure 5:
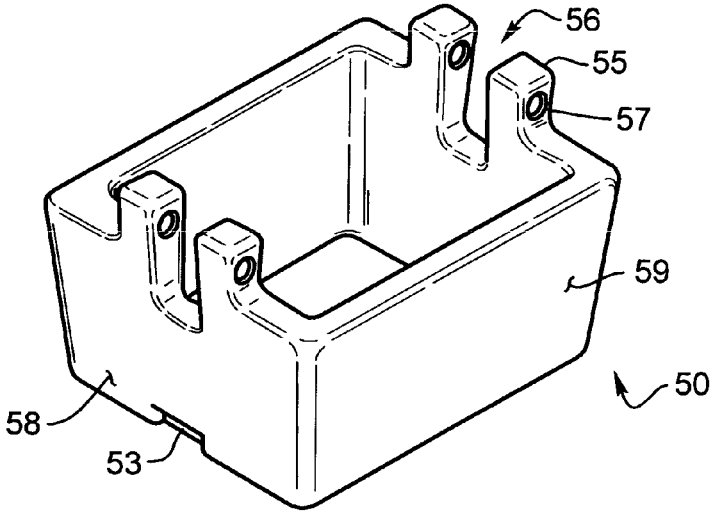
FIG. 5 is a top perspective view of the third nested weight plate.

FIG. 5 shows the third nested weight 50, which has no apertures in the end walls 58 or the side walls 59. It has an indented portion 53 for engaging the tab portion 44 on second nested weight 40, which supports the third nested weight 50 in the second nested weight 40.

Figure 6:
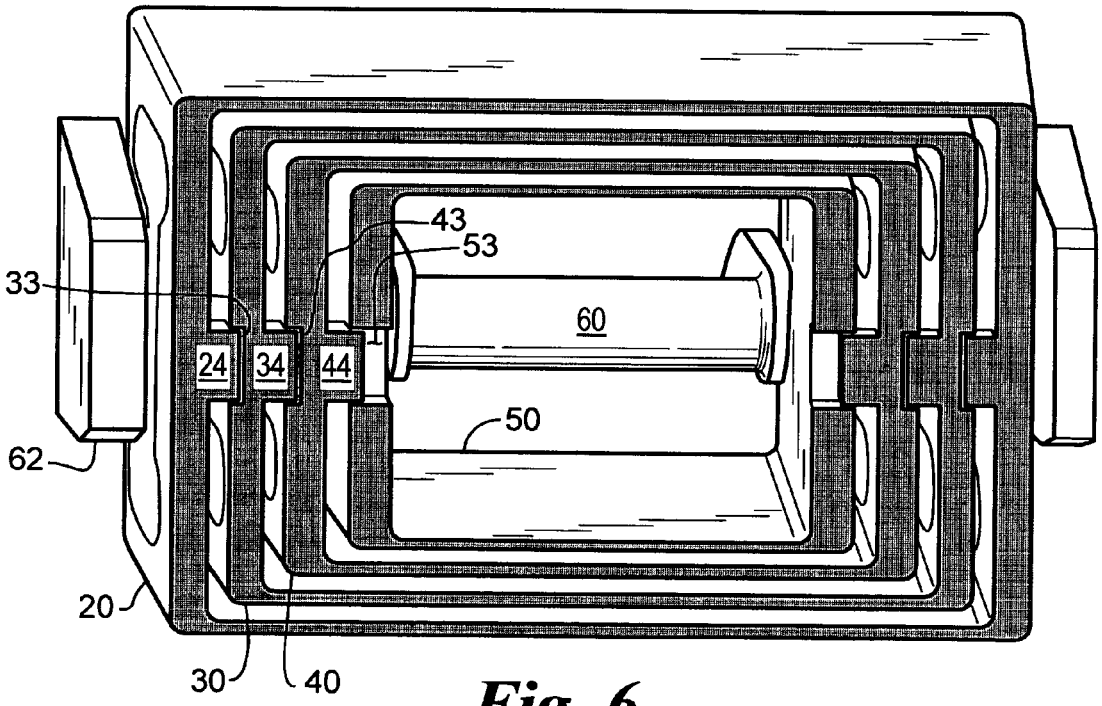
FIG. 6 is a bottom perspective view of a dumbbell with nested weight plates.
Figure 7:
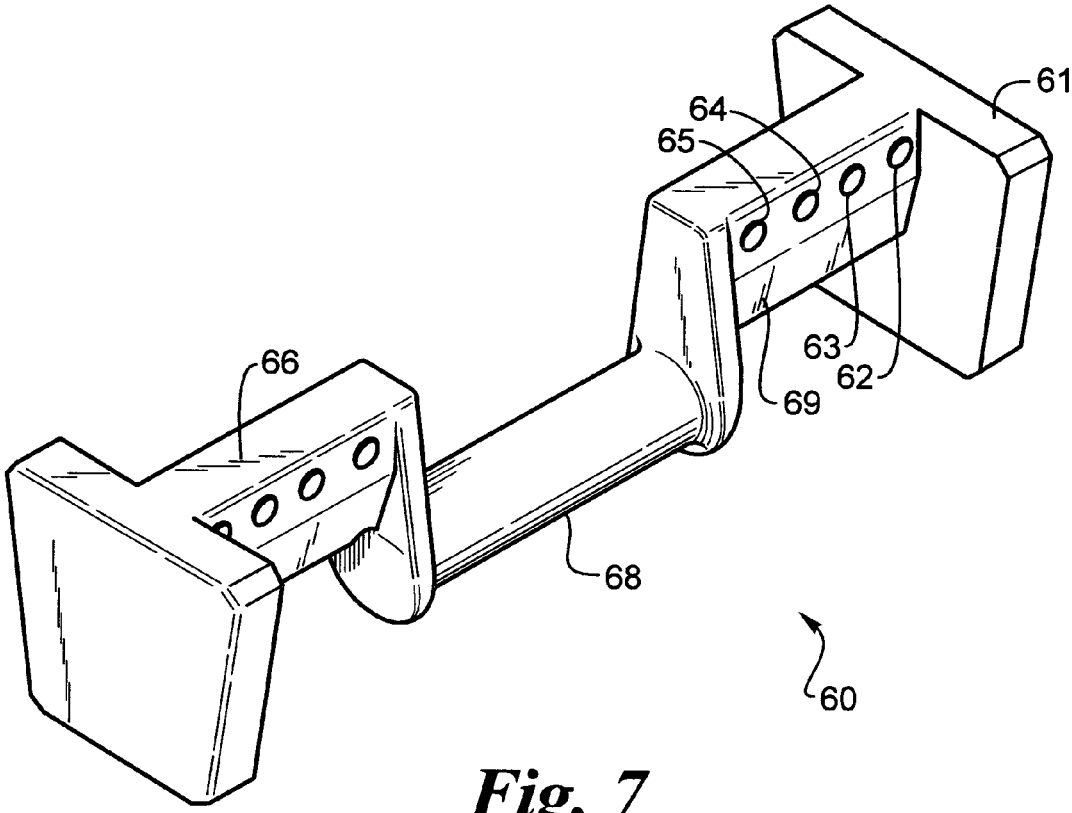
FIG. 7 is a top perspective view of a handle with weights on each end.
Figure 8:
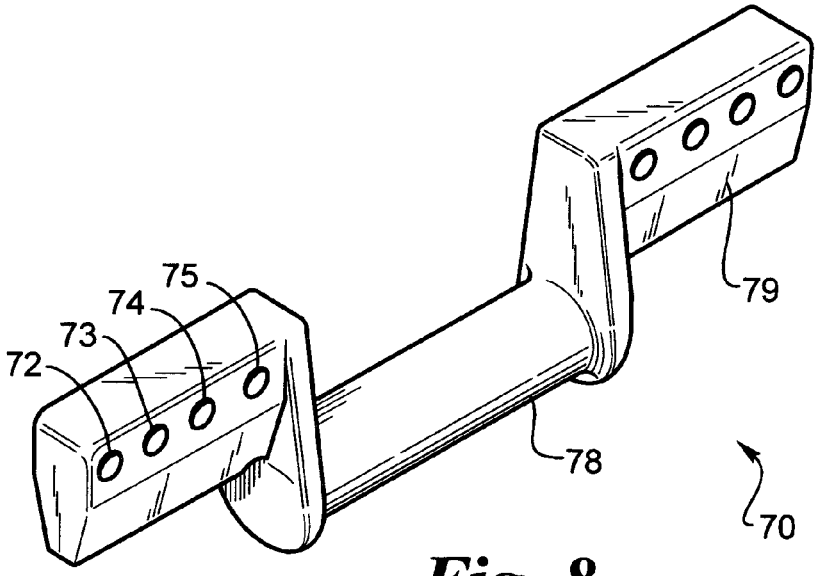
FIG. 8 is a top perspective view of a handle.

FIG. 6 shows how the tabs portions 24, 34, 44 on weights 20, 30 and 40 engage and support the indented portions 33, 43, and 53 on weights 30, 40 and 50.

Handles 60 and 70 differ in that handle 60 has weights 61 attached at either end. This allows the handle 60 for example 10 pounds to match the weight of the weights 20, 30, 40 and 50 whereas handle 70 is lighter and may be only half the weight of handle 60 for example 5 pounds.

Both handle 60 and handle 70 have apertures 62, 63, 64, and 65 and 72, 73, 74, and 75 respectively for engaging the apertures 27, 37, 47, and 57 respectively in the weights such that the handles 60 and 70 can be connected by pin 80 having a stop 82 which may be magnetic for stopping the pin 80 from being removed from the apertures in the weights and the handles. In this manner the handles are secured to the weights and the weights may be lifted. The handles 60 and 70 have hand grips 68 and 78 respectively which may be knurled or have finger grips thereon for better gripping of the hand grips 68, 78. The tappered ends 69, 79 of the handles 60, 70 help guide the handles into the troughs 26, 36, 46, 56 on the weights 20, 30, 40, 50 and align the hand grips 68, 78 in the dumbbell assembly 10.

Figure 9:
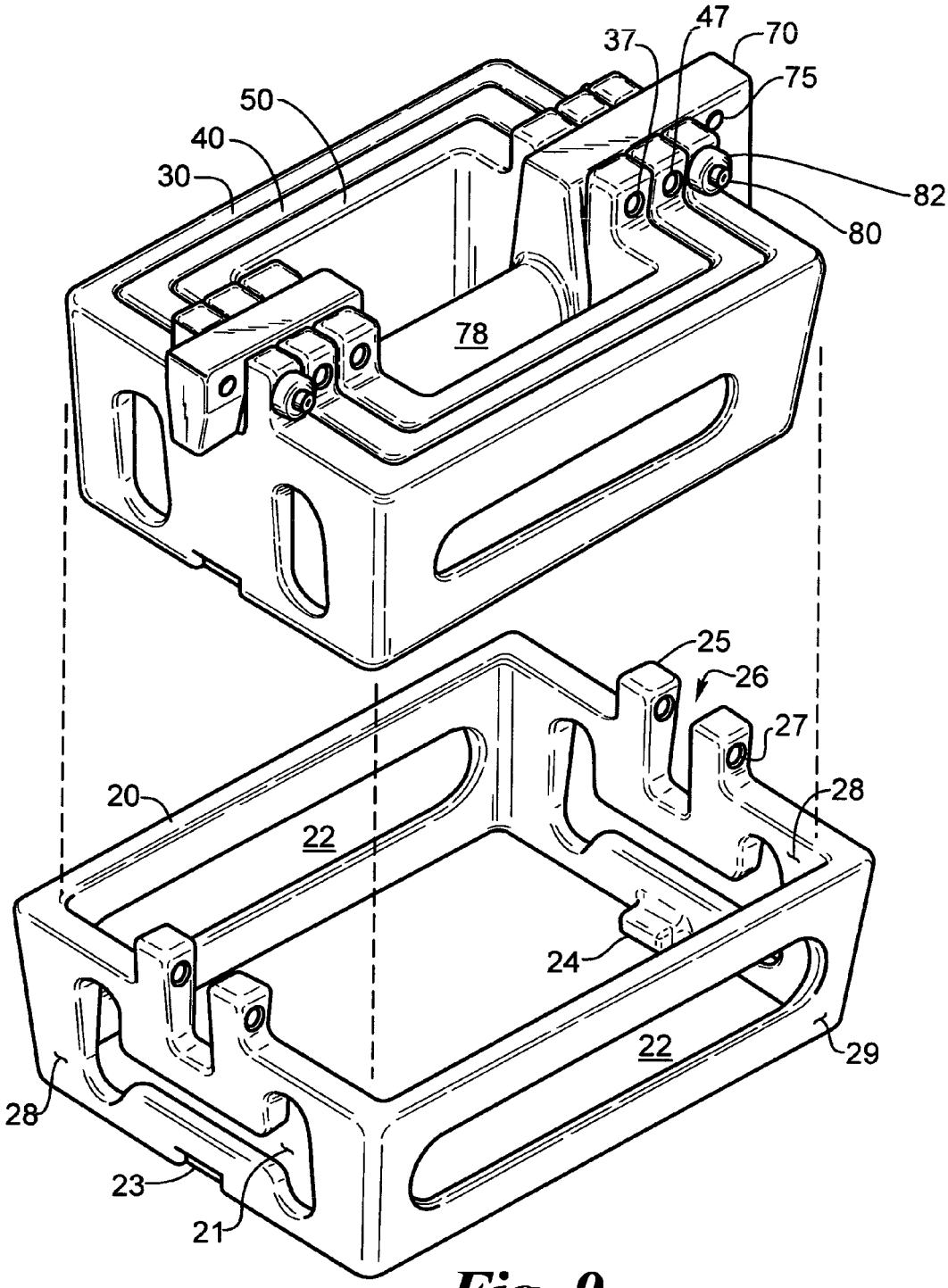
FIG. 9 is a top perspective view of a dumbbell with nested weight plates and a handle with no weights.

As best seen in FIG. 1, when the handle 60 is attached to outer weight 20 by placing pin 80 though apertures 27 on weight 20 and aperture 62 on handle 60 all of the weights 20, 30, 40 and 50 are covered by the bar portion 66 on handle 60 with tapered portion 69 engaging troughs 26, 36, 46, 56 thus preventing the weights 30, 40 and 50 from leaving their nested position. Handle 60 will lift all the nested weights 20, 30, 40 and 50 since weights 50, 40 and 30 are nested in weight 20 and held by their respective tab portions 44, 34, 24 engaging indent portions 53, 43, 33. As best seen in FIG. 9 when handle 70 has pin 80 through aperture 37 in first nested weight 30 and aperture 73 in handle 70 the handle 70 will lift weights 30, 40 and 50 leaving weight 20 behind. Thus the weight of the dumbbell assembly 10 is reduced. Similarly the weight of the dumbbell assembly 10 can be further reduced by having pin 80 engage apertures 47 on weight 40 and 74 on handle 70 for lifting only weights 40 and 50. For the least weight the dumbbell assembly uses handle 70 to engage only third nested weight 50.

In other embodiments the number of weights and the mass of the weights may vary to provide larger or smaller ranges of weights available in the dumbbell.

Although the weights in the embodiments shown have been trapezoidal pyramid sections any shape weights can be used including semicircular sections, cylindroidal sections, triangular pyramid sections, quadrangular pyramid or any number of sided weights with inclined or curved walls for nesting one section inside of another.

Figure 10:
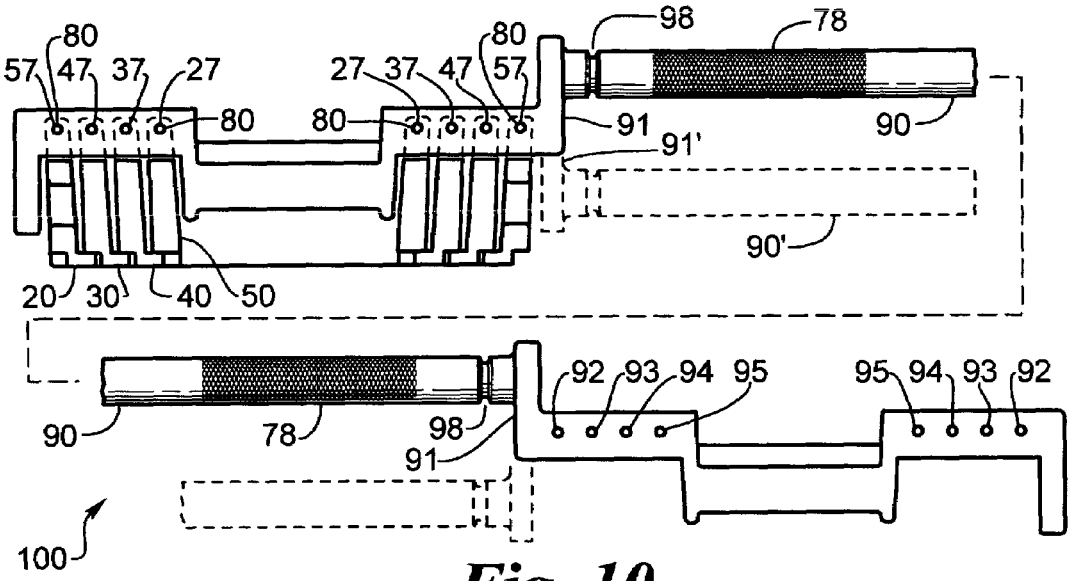
FIG. 10 is a side view of a barbell embodiment.

In another embodiment the weights 20, 30 40 and 50 can be engaged by a barbell handle 90 such as for a barbell 100 as shown in FIG. 10. In the embodiment shown the nesting weights 20, 30 40 and 50 are the same as in the dumbbell assembly. The pins 80 extend through apertures 57, 47, 37 and 27 in the weights and corresponding apertures 92, 93, 94, 95 in the barbell handle 90. FIG. 10 shows the bar 90 having an arm 91 for extending the weights 20, 30, 40, 50 below the bar 90 so that the base of the weights will tend to remain parallel to the floor. Alternatively, the arm 91 can be inverted so that the bar 90' and arms 91' shown by the dashed lines extends between the center of the weights 20, 30, 40, 50 so that the center of gravity is in the center of the weights 20, 30, 40, 50 and the barbell 100 can be rotated easily with the bar 90 as an axis.

Figure 11:
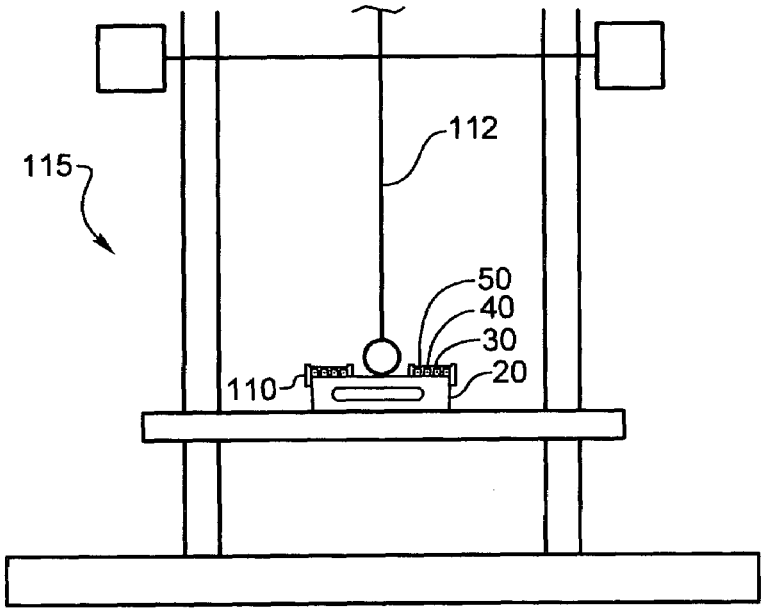
FIG. 11 is a side view of an exercise devise embodiment.

Similarly for exercise machines, which utilize variable weights such as weights 20, 30, 40 and 50, can have a handle 110 connected to a cable 112 on the weight machine 115 as shown in FIG. 11. The nested weights can be selected by moving pins 80 on the handles 110 to engage different nested weights to add or subtract weight as with the dumbbells.

Figure 12:
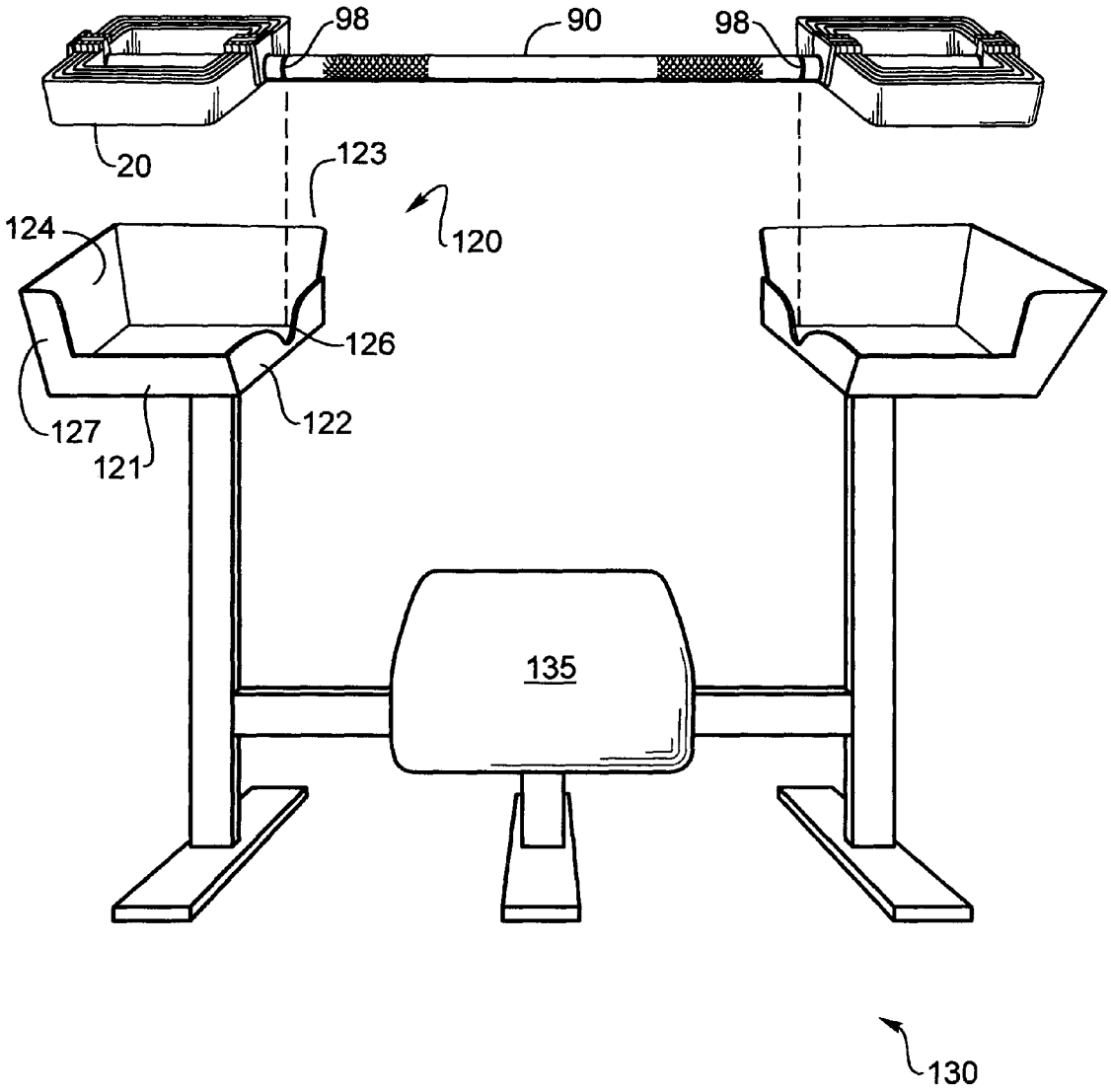
FIG. 12. is a front perspective view of the weight bench with a barbell.

FIG. 12 shows a weight bench 130 having a cushion 135 used by weight lifters using barbells. The barbell 90 may have notches 98 along the length to align the barbell 90 with the weights 20, 30, or 40 inside weight housing 120 or align weight 20 with the weight housing 120. Notches 95 on barbell 90 when aligned with V shaped trough 126 in the inside wall 122 of housing 120 will align the weights for nesting in the housing 120 or in other weights. The V shape of notch 126 will guide the barbell 90 toward the center of the housing from the front wall 121 to the back wall 123. The notch 98 in the barbell 90 will in addition to the front to back alignment will provide side to side alignment such that the weights are guided into the housing 120 or into weights 20, 30, 40. The outside wall 124 of housing 120 is tapered toward the center of the housing 120 to provide guidance for the weights to focus them on the housing or the other weights to nest therein. The tapered flange 127 in outside wall 124 also guides the weights toward the center of the housing 120. Similarly rear wall 123 is tapered toward the center of the housing to guide the weights therein. Rear wall 123 is preferably not as high as outer wall 124 to allow for easier placement of the weights into the housing from the rear. Front wall 121 is also tapered toward the center of housing 120. Front wall 121 is low to facilitate having the weight clear it for placing the weights in the housing and for taking the weights out of the housing to begin exercising. Inside wall 122 may also be tapered toward the center to facilitate centering the weights 20, 30, 40, 50 into the housing 120 or for nesting it in another weight.

Figure 13:
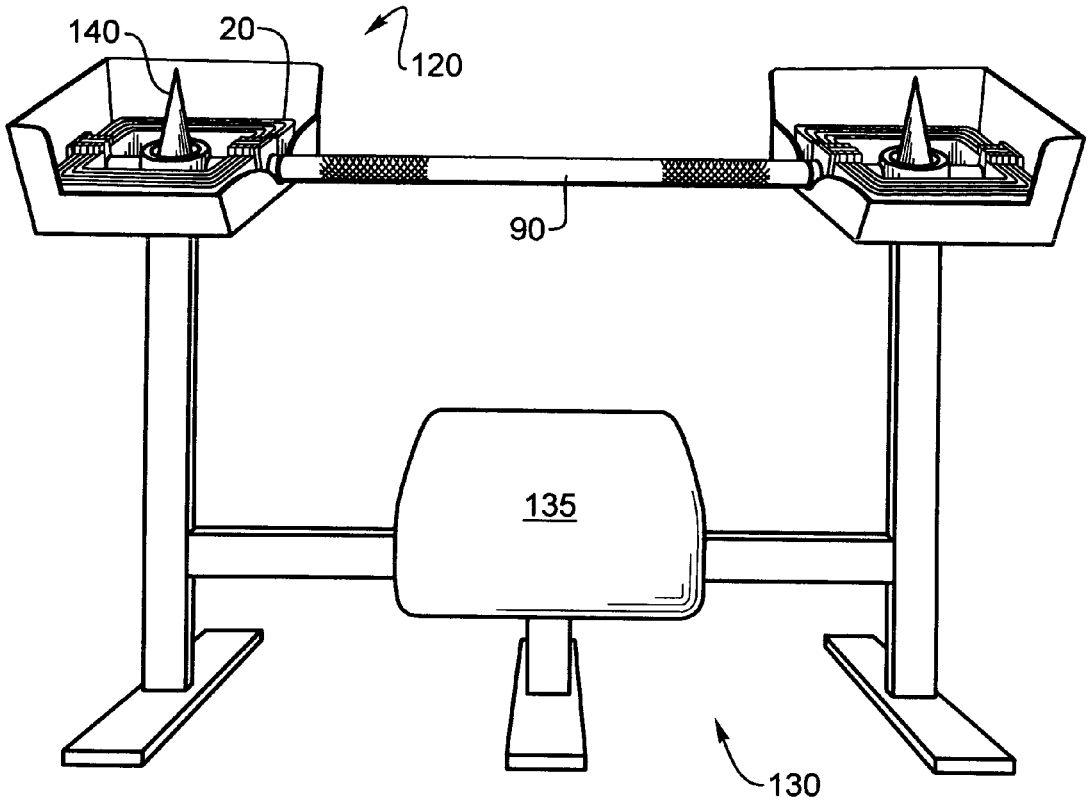
FIG. 13. is a front view of the weight bench with a barbell in a second embodiment.
Figure 14:
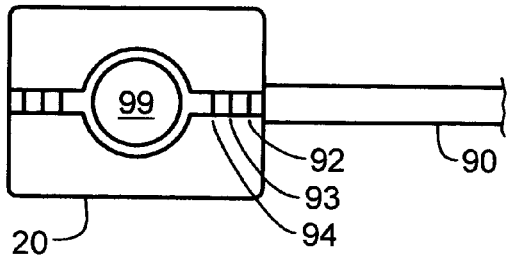
FIG. 14 is a top view of a barbell with a circular aperture in the handle.

Alternatively as shown in FIG. 13, 14 the bar 90 can have a circular opening in the center of the hollow interior portion of the weights, 20, 30, 40, 50 such that it can mate with a cone 140 in the center of housing 120 to guide the weights down to perfectly nest with the housing or other weights container therein.

The weights and handles as described herein can be made of any material, which is strong and has a high density. The preferred materials are metals such as iron or steel. The apertures 21, 22, 31, 32, 41, 42, 51, 52 in the weights 20, 30, 40, and 50 can be any size or shape and be located anyplace to make the weights the correct mass.

Obviously, many modifications and variations of the present invention are possible in light of the above teachings. It is therefore to be understood that, within the scope of the appended claims, the invention may be practiced otherwise than as specifically described.

What is claimed is:

1. A nested adjustable weight exercise device comprising, a first weight having end walls and side walls, the walls forming a perimeter with a hollow interior portion, the end walls having an upstanding fork portion with apertures therethrough and a trough between the upstanding fork portions, at least one additional weight having end walls and side walls forming a perimeter with a hollow interior portion, the at least one additional weight nesting within a weight selected from one of the first weight and at least one additional weights, the end walls having two upstanding portions forming a fork with an aperture in each upstanding portion and a trough between the upstanding portions, a handle having a bar portion with a plurality of apertures for alignment with the apertures in fork on each end of the weights and fitting in the troughs of the first and the at least one additional weight, a pin for extending though an aperture in the bar and corresponding apertures in the forks of the weights for attaching the bar to one of the weights such that lifting the handle will lift the weight it is attached to and any weight nested therein.

2. A nested adjustable weight exercise device as in claim 1 wherein, the walls of the weights are tapered with the small end at the bottom to nest one weight within another.

3. A nested adjustable weight exercise device as in claim 2 wherein, a tab on the interior of the end walls engages an indented portion of the outer part of the end walls to nest the weights within each other.

4. A nested adjustable weight exercise device as in claim 1 wherein, a tab on the interior of the end walls engages an indented portion of the outer part of the end walls to nest the weights within each other.

5. A nested adjustable weight exercise device as in claim 1 wherein, the handle has a hand grip portion centered in the interior of the weights.

6. A nested adjustable weight exercise device as in claim 1 wherein, the walls of the weights have apertures to reduce the mass of the weight such that the weights all have equal mass independent of the length of the walls.

7. A nested adjustable weight exercise device as in claim 1 wherein, the handle has plates on both ends to increase the mass of the handle.

8. A nested adjustable weight exercise device as in claim 1 wherein, the pin has a stop at one end to prevent the pin from exiting the apertures on the weights.

9. A nested adjustable weight exercise device as in claim 1 wherein, the pin has a magnetic attachment at one end to prevent the pin from exiting the apertures on the weights.

10. A nested adjustable weight exercise device as in claim 1 wherein, the handle having a hand grip in the interior of the inner most nested weight to form a dumbbell.

11. A nested adjustable weight exercise device as in claim 1 wherein, the handle centered between two sets of nested weights to form a barbell.

12. A nested adjustable weight exercise device as in claim 11 wherein, a weight bench having a housing for holding the weights with the housing having a V shaped portion on an inner wall, the inner wall tapered inward toward the center of the housing to guide the weights to the center of the housing, an outside wall tapered toward the center of the housing, a front wall tapered toward the rear of the housing and a rear wall tapered toward the front of the housing, a notch in the barbell to engage the V shaped notch in the inner wall of the housing to guide the weights into the center of the housing such that the nested weights can be set down with the weights centered in the weight housing or nested in the weights.

13. A nested adjustable weight exercise device as in claim 11 wherein, the handle has a circular aperture centered in the interior portion of the weights, a weight bench having a housing for supporting the weights and a cone extending upward to a point from the center of the housing for engaging the circular aperture of the handle such that the cone guides the barbell into the housing.

14. A nested adjustable weight exercise device as in claim 11 wherein, the barbell has the same center of gravity as the weights such that the barbell can easily rotate the weights on its axis.

15. A nested adjustable weight exercise device as in claim 1 wherein, a cable is attached to the handle to connect the weights to an exercise machine.

* * * * *